US006109926A

United States Patent [19]

Blum et al.

[11] Patent Number: 6,109,926

[45] **Date of Patent: *Aug. 29, 2000**

[54] ROTARY CONDUCTOR RAIL LEADTHROUGH

[75] Inventors: Matthias Blum, Büdingen; Wilfried Goy, Kelsterbach; Hilmar Lippert, Alzenau; Bernd Sitzmann, Maintal, all of Germany

[73] Assignee: ALD Vacuum Technologies AG, Erlensee, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/810,151

[22] Filed: Feb. 25, 1997

[30] Foreign Application Priority Data

Feb. 26, 1996 [DE] Germany ..... 196 07 217

[51] Int. Cl.[7] ..... H01R 13/533; H01R 39/00

[52] U.S. Cl. ..... 439/3; 439/13

[58] Field of Search ..... 439/3, 13, 22, 439/196

[56] References Cited

U.S. PATENT DOCUMENTS

| | | | |
|---|---|---|---|
| 4,492,423 | 1/1985 | Reuter | 439/22 |
| 5,127,836 | 7/1992 | Reuter | 439/3 |

FOREIGN PATENT DOCUMENTS

| | | |
|---|---|---|
| 1540659 | 1/1970 | Germany . |
| 2318690 | 10/1974 | Germany . |
| 8001450 | of 1980 | Germany . |
| 3219721 | 12/1983 | Germany . |
| 3935440 | 5/1991 | Germany . |
| 4122574 | 1/1993 | Germany . |

*Primary Examiner*—Gary F. Paumen
*Attorney, Agent, or Firm*—Fulbright & Jaworski, LLP

[57] ABSTRACT

A current connection suitable for transferring high-frequency, high-amp current consists of a stationary feed line part (2) and a rotational part (4), each of which is connected to paired conductor rails (6, 8; 6', 8'). The conductor rails (6, 8; 16, 18), connected at one end to a power generator and at the other end to the stationary feed line part (2), consist essentially of at least two parallel conductor rails, which are kept a certain distance apart by means of an insulator (5*a*). As a result of flexible power conductors (10, 10'), electrically conductive manner to the circular periphery of the outer conductor ring (14), the other end to inner conductor ring (15), the rotational part (4) can be rotated with respect to the stationary feed line part (2) in correspondence with the length of the current conductors (10, 10', . . . ; 11, 11', . . . ). The conductor rail (16, 18), consisting of two individual conductors (16, 18), is connected electrically to the individual poles of the rotational part (4) and projects at the other end through a leadthrough plate (20) into a sealable process chamber, in which, by means of the rotatable power connection, a melting device can be supplied with operating current. By means of the power connection, currents of up to I=20,000 A at voltages of up to U=500 V and at operating frequencies of up to f=10 kHz can be transferred.

10 Claims, 3 Drawing Sheets

56
5b
18
16
20
24
26
52''
52'
52
10,10',...
2
14b
14a
5b
17b
17a
18
16
11,11',...
4

ROTARY CONDUCTOR RAIL LEADTHROUGH

BACKGROUND OF THE INVENTION

The invention pertains to a high-current rotary connection for the leadthrough of electric power lines to movable electrical loads in closed spaces.

Rotary high-current connections of the type cited above are required to supply large operating currents to closed spaces, when, for example, limited rotational and pivoting motions must be executed between structural components inside and outside the boundary walls of the spaces. These requirements are present in the case of, for example, systems such as melting and casting units supplied with electric current, especially with medium-frequency alternating current, in which the molten material is poured out by tipping a crucible, the crucible forming a single structural unit with the heating device. High-current connections of the type described above, however, are not limited to uses only in melting and casting furnaces.

It is important that the high-current connections of the general type in question are also intended to serve simultaneously to supply and carry away coolants, by means of which furnace components such as the induction coils used in induction melting processes can be protected from overheating.

In systems where there are pressure differences between the two sides of the boundary walls of the closed spaces, such as in the case of vacuum furnaces, for example, there are also special requirements on the leak-tightness of the high-current connections.

High-current connections of the type described above are known (corresponding to U.S. Pat. Nos. 4,492,423 and 5,127,836). from, for example, DE 41 22 574 A1 and DE 32 19 721. The high-current connection described in DE 41 22 574 A1 consists essentially of a stationary, coaxial arrangement of an electrically conducting internal pipe and an external pipe together with a rotatable current conductor arrangement which is coaxial to the stationary coax conductor unit. By means of flexible current bridges, the first coax conductor unit is electrically connected in a bipolar manner to the second coax conductor unit. The coax conductor units known from DE 41 22 574 A1 open at the ends into four adjacent, ring-shaped metal flanges, which are arranged concentrically to each other in pairs and are connected to each other by stranded wires bent into the shape of U's in such a way that in each case the inner and outer ring-shaped flanges are at the same potential. The inner, rotatable ring flanges have essentially the same diameter and close off on the one side the end of the internal coax pipe and on the other side the end of the outer coax pipe. The stranded wire bundles of the one potential are approximately mirror images of the stranded wire bundles of the other potential. Care is taken to ensure that the pivot angle is sufficiently large by making the loops of the stranded wires sufficiently long.

The electric current is supplied to each of the outer, stationary flanges by means of a radially oriented current conductor.

In a design of the type described above, e.g., that according to DE 32 19 721, the problems associated with thle difficulty of transferring high electrical currents efficiently, especially in the upper medium-frequency range, have been found to be disadvantageous. Thus, for example, the electric current is introduced to the opposing flange in only a local manner, that is, only within the confines of the part of a sector situated at the outer radial edge. As a result, the electric current being supplied is not distributed uniformly or completely over the ring flanges. The solution proposed in DE 41 22 574 A1, namely, to provide the current-supplying coax conductor arrangement with a certain minimum length, does not solve this problem completely, even though that is the goal. Because the electric current always tries to flow along the shortest possible route, the current is not distributed homogeneously around the opposing ring-shaped flanges. Instead, the disadvantageous situation develops that the current flows into the opposing flange almost exclusively through the stranded wires near the external coax feed lines adjacent to the current feed conductor. This leads to differences in the thermal loads on the stranded wires, which is disadvantageous; as a result, these stranded wires are sometimes produced with different diameters, even though this increases the production cost.

The coaxial current conductor arrangement known from DE 41 22 574 A1 also suffers from the disadvantage that the alternating current resistance of the current-carrying coax conductors and the stranded wire conductors increases as a result of the increasing resistance at higher operating frequencies. Higher resistances, however, bring with them the disadvantage of extra thermal loads on the individual stranded wire conductors. Although, when new and still protected by a sound layer of insulation, these wires can handle high current loads, the continuous rotational movement and the associated abrasion of the stranded wires nevertheless leads to a current distribution in the stranded wires similar to that found in uninsulated stranded wire conductors. Such uninsulated stranded wire conductors, however, are unsuitable for high alternating currents at high operating frequencies, because they are associated in a disadvantageous manner with power transfer losses.

SUMMARY OF THE INVENTION

The task of the present invention is to make available a rotary, high-current connection of the general type described above, which transfers power more effectively than the high-current connection described above and which nevertheless avoids the disadvantages of the known connections.

The task thus described is accomplished in the high-current leadthrough proposed in accordance with the invention by means of the following features, which operate independent of each other, namely:

(a) the stationary current conductor connection provided between the stationary ring flange pair and the current generator consists of essentially parallel conductor rails, where the adjacent, current-carrying, facing external surfaces of the individual conductors are separated from each other by an insulator provided between the facing external surfaces, and where the thickness of the insulator layer is minimal for a given electrical potential difference between the adjacent individual conductors and the insulating power of the insulator;

(b) the electrically conducting connection between the stationary current feed and/or the stationary ring flange on the one hand and between the rotating ring flange and the rotating current conductor permanently connected to it on the other hand is accomplished by means of a large contact surface, extending in each case in the peripheral region of the ring flange;

(c) the current rails between the current generator and the stationary ring flange on the one hand and/or the current rails provided between the electrical load and the rotating ring flange on the other have a cooling device; and (d) the current rail permanently connected to the rotatable ring flange projects through a leadthrough plate, connected in a vacuum-tight manner to the rail, this plate being provided on a vacuum-tight, rotating flange on the vacuum chamber wall in the closed space holding the electrical load.

First, as a result of features (a) and (b) according to the invention, the inhomogeneous current distribution over the stationary ring flange characteristic of the known coaxial current feed is avoided, because the electric power can be supplied to the flexible current conductors (stranded wires) over the entire periphery of the stationary ring flange. It is provided that the contact surface area between the stationary ring flange and the stationary current conductor is preferably designed on the peripheral side of the ring flange. The total area of the contacted segment of the periphery should be greater than one-third of the total peripheral area.

In addition, because of the closely adjacent arrangement of the current-carrying surfaces of the selected current rails, induction losses are minimized.

As a result of the simple design of the current rails used, these rails can be provided with a cooling apparatus by means of simple structural measures. It is advantageous for a cooling apparatus of this type to consist, for example, of channels formed in the current rails, through which a liquid coolant flows, the channels extending parallel to each other over the length of the current rails. As an alternative, it is proposed that the current-carrying conductor pairs be produced from individual tubular conductors, through which a liquid coolant, provided especially for cooling, can be circulated to stabilize the temperature of the current conductors. To keep the conductor resistance low, it is provided that the conductor rails be produced of a highly conductive metal alloy, preferably of a Cu alloy.

With the proposed features of a current leadthrough according to the invention, it is possible, for example, to achieve the reliable transfer of alternating currents with current intensities of up to i=20,000 A at a voltage of U=500 V at a.c. frequencies of up to f=10 kHz. At lower alternating currents, it is possible to transfer at even higher frequencies of f>10 kHz. The voltage can be increased beyond 500 V, for example, by carrying out work under a shield gas, by increasing the dielectric strength of the insulating material, or by sheathing the conductors completely with a layer of insulation.

It is especially advantageous to combine features (a)–(d) with each other. In this case, the current connection according to the invention is able to ensure an especially efficient transfer of current between the current generator and the electric load.

DETAILED DESCRIPTION OF THE PREFERRED EMBODIMENT

High-current connection 1 consists essentially of a stationary current feed part 2 and a rotational part 4, which is able to move with respect to stationary feed part 2. Rotational part 4 is able to rotate around an axis of rotation A–A' within the length of flexible current conductors 10,–10', . . . ; 11, 11', . . . . which connect rotational part 4 and stationary feed part 2.

Figure 1:
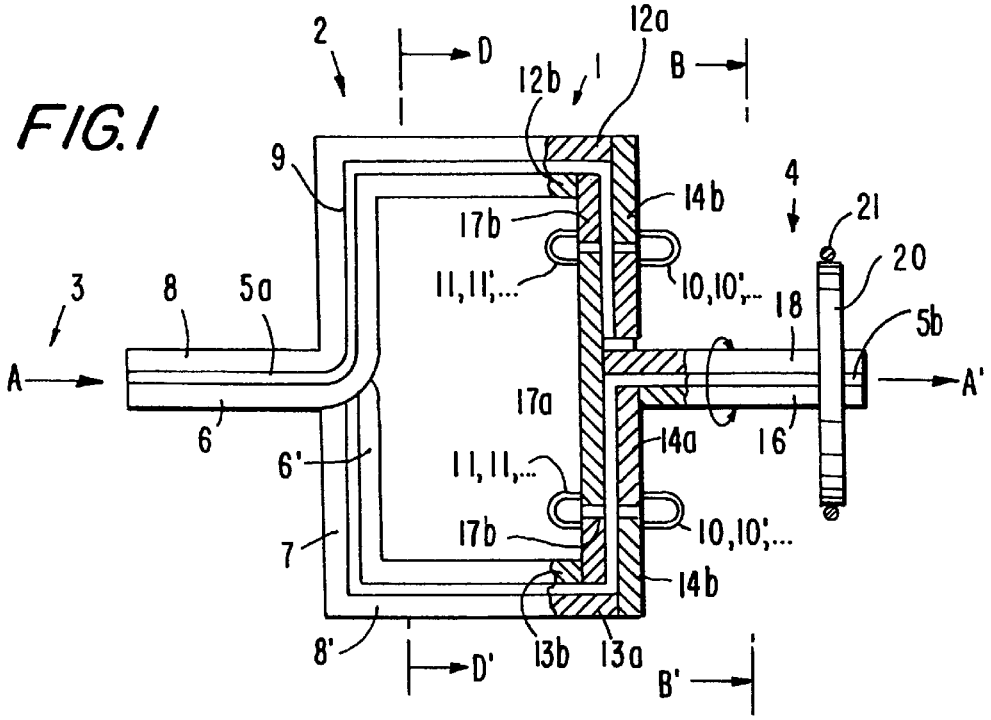
FIG. 1 shows a schematic diagram of the layout of the individual current conductors in partial axial cross section.
Figure 3:
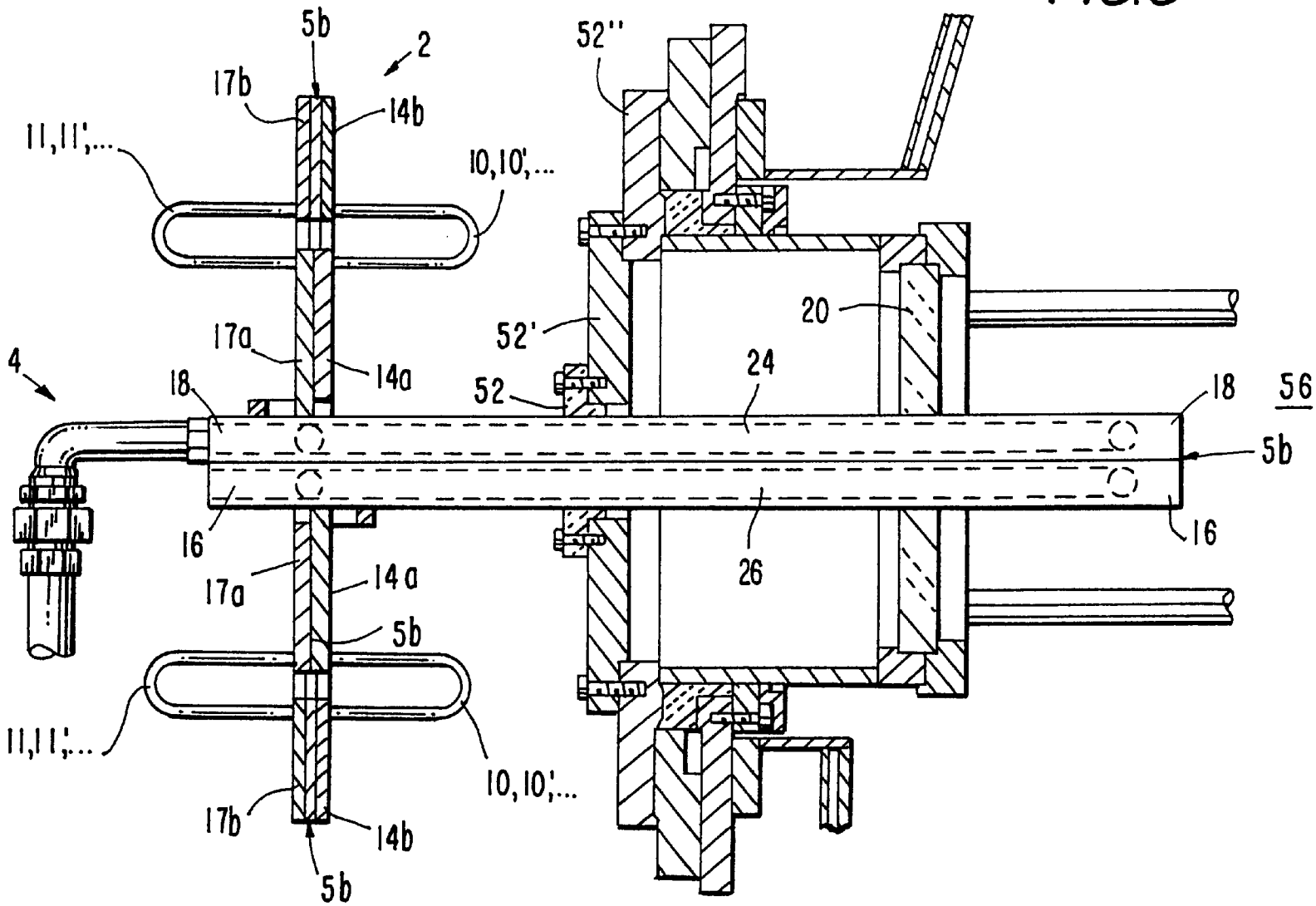
FIG. 3 shows an axial cross section through a high-current connection with part of a chamber of a crucible used for the induction melting process, into which chamber the rotating current conductor pair, designed as a pair of conductor rails, projects.
Figure 4:
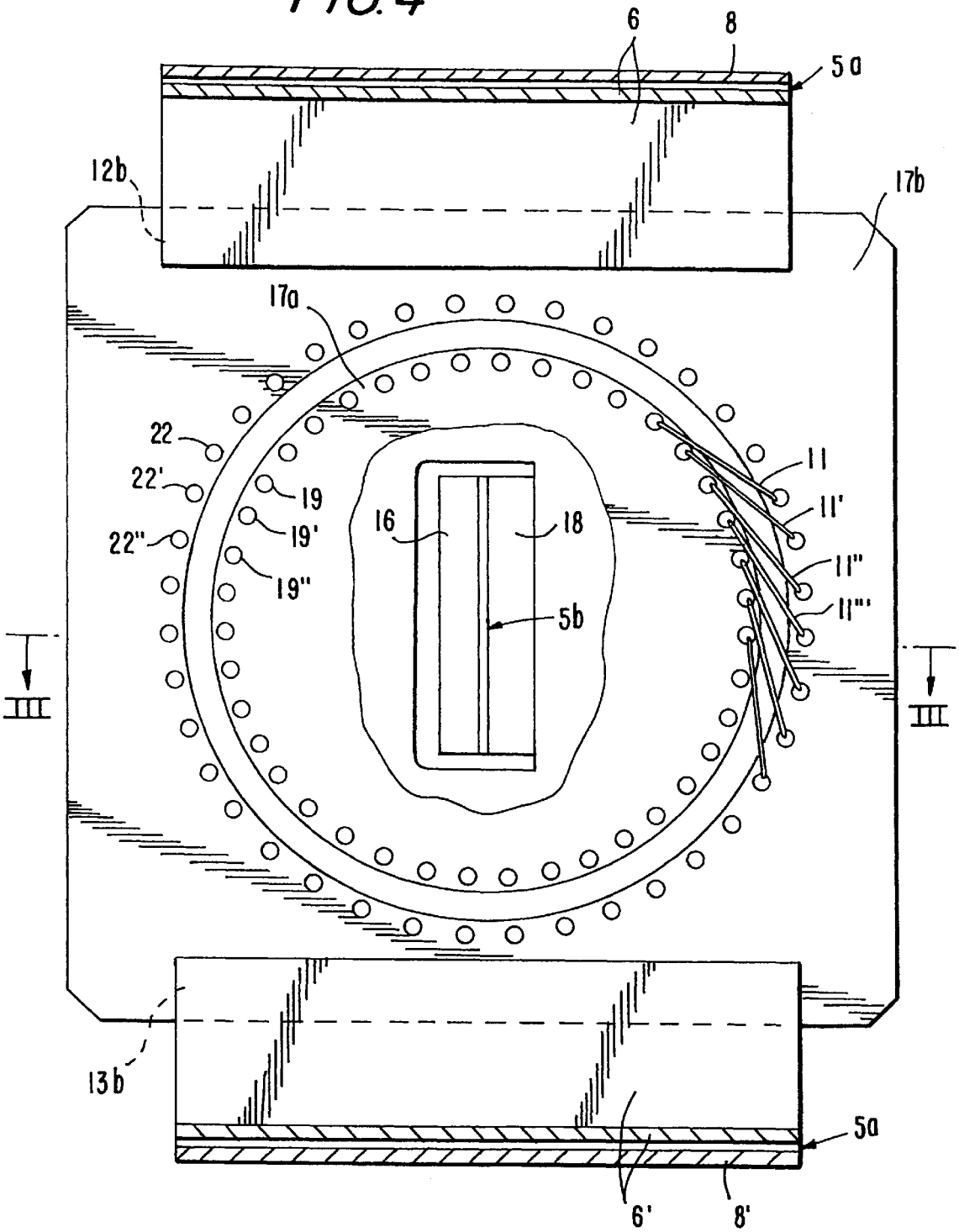
FIG. 4 shows a cross-sectional view along cross-sectional plane D–D' of FIG. 1.

Stationary feed part 2 consists essentially of two pairs of conductor rails, not shown in FIG. 3; each pair consists of individual current conducting rails 6, 8; 6', 8' (see FIGS. 1 and 4). The current feed rails, connected at one end to the electrical outputs of an a.c. generator 3 (not shown in FIG. 1), are bent three times at defined lengths in such a way that the free ends 12*a*, 13*a*; 12*b*, 13*b* of the conductor rails opposite to each other. (see FIG. 1 ) Free ends 12*a*, 13*a*; 12*b*, 13*b* of the individual conductors 6, 6'; 8, 8', which are connected electrically in parallel, thus lie opposite each other.

The free ends of the individual current conductors 6, 6'; 8, 8' are connected in pairs by means of flexible current conductors (stranded wires) 10, 10', 10", 11, 11', 11" in such a way that in each case an inner flange 15*a* and outer ring flange 12*b* are at the same potential. Back-to-back ring flanges 15*a*, 15*b* and 12*a*, 12*b* of different polarity are separated electrically from each other by insulating rings (not shown in the figures), but mechanically they form a single construction unit, inner ring flanges 12*a*, 12*b* being able to execute a limited pivoting motion with respect to outer ring flanges 15*a*, 15*b*. The ends of stranded wires 10, 10', . . . ; 11, 11', . . . are soldered into axially oriented bores 19, 19', 19", preferably soldered. Stranded wire bundles 10, 10', of the one potential are approximately mirror-symmetric to the stranded wire bundles 11, 11', . . . of the other potential, the plane of symmetry being located approximately within the insulating rings between flanges 12 and 15. By providing stranded wires 10, 10', . . . ; 11, 11', . . . . with loops of appropriate length, it is ensured that the pivot angle is sufficiently large. An insulator 5*a*, 5*b* is provided between the individual current conductors 6, 8; 6', 8' of the current conductor rails extending from generator 3 to outer ring flanges 12. A plastic film made of nonconductive material or a nonconductive adhesive insulating joint is provided as insulating material. The distance between current conductors 6, 8; 6', 8' separated from each other by the layer of insulation is typically 0.7 mm for a potential difference between the individual conductors 6, 8 of U=500 V.

The rotatable current conductor pair connected to rotatable inner ring flange 14*a* and 17*a* consists of two individual conductors 16, 18, each of which is separated from each other with respect to their potentials by means of a layer of insulating material 5*b*, and each is connected in an electrically conductive manner to the facing inner Ring flange 14*a*, 17*b*. With their free ends, the individual current conductor rails 16, 18 project into chamber interior 56 through a leadthrough plate 52, resting in a vacuum-tight but rotatable manner on vessel wall 52', 52", as shown in FIG. 3. In the interior of the chamber, an electric load (not shown in the drawings) is supplied with the electrical energy by way of the current connection.

Figure 2A:
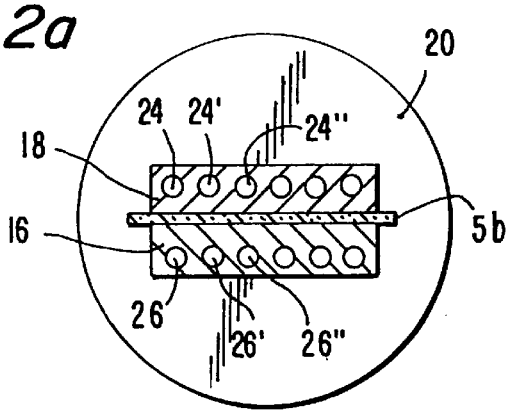
FIG. 2*a* shows a cross-sectional view of a current conductor pair, designed as current conductor rails, along cross-sectional line B–B' of FIG. 1 according to a first exemplary embodiment.
Figure 2B:
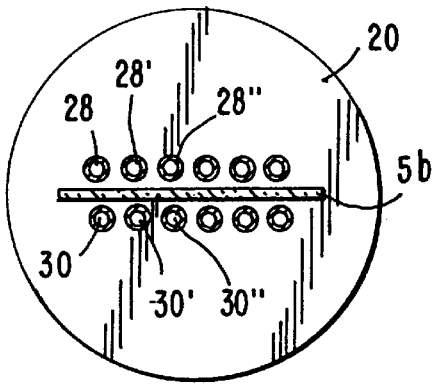
FIG. 2*b* shows a cross-sectional view of a current conductor pair consisting of conductor tubes along cross-sectional line B–B' of FIG. 1 according to a second exemplary embodiment.

The individual conductor rails 16, 18 connected to rotating ring flanges 14*a* 17*a* can have, for example, the rectangular cross-sectional profile shown in FIG. 2*a*. To regulate the temperature of the individual current conductors 16, 18, channels 24, 24', 24", these channels being parallel to each other in the longitudinal direction of the rails, and through which a liquid coolant can be circulated to cool the individual conductor rails 16, 18. As an alternative, as illustrated in FIG. 2*b*, the individual current conductors can also consists of a group of individual tubular conductors 28, 28', 28", through which the liquid coolant can be circulated. The coolant is supplied, as shown in FIG. 3*a*, through feed lines 50 and discharge lines 51.

A plurality of axially oriented bores 19, 19', 19", into which one end of U-shaped stranded wires 10, 10', 10", 11", other, is provided in the radially outward-lying areas of flanges 14, 15. The other ends of stranded wires 10, 10', the opposite flanges 14*b*, 17*b*, which for this purpose are provided with the same number of axially oriented bores 22, 22', Opposing flanges 17*b*, 14*b* are arranged in a position radially outside flanges 17*a*, 14*a*, but do not touch them. Between opposing flanges 14*a*, 17*a* there is a spacer ring made of insulating material, by means of which opposing flanges 14*a*, 17*a* are connected permanently together to form a rigid structural unit.

What is claimed is:

1. Rotatable current connection for passing electric feed lines through to movable internal components in closed spaces, with a) first and second stationary outer conductor flanges having coaxial central openings and being separated by insulating conductor pair to an outer power generator, b) third and fourth rotatable inner coaxial conductor flanges being positioned in the said central openings, separated by insulating means and connectable by a second rotatable separated conductor pair to the said internal components, first and second conductor pairs having a common axis, and with c) two groups of flexible connecting lines, one group connecting the first and third conductor flanges and the other group connecting the second and fourth conductor flanges, wherein d) the first and second conductor pairs are flat conductor means, parallel to each other and separated each by flat insulating material, whereby e) one conductor pair is bent away from and then return to the said common axis and electrically attached to the outer conductor flanges, f) the outer conductor pair is essentially straight and electrically attached to the inner conductor flanges, g) the individual conductors of the said conductor pairs being hold at a uniform distance being defined by the thickness of the layer of the said insulating material and selected so that the distance is minimal for a given voltage difference between the individual conductors and minimal with respect to the insulating capacity of the said insulating material.

2. Current connection according to claim 1, wherein the pairs of current conductors, consisting of individual conductors, are designed as paired conductor rails, where the insulator-provided between conductor rails consists of an electrically insulating, dielectric material, preferably a plastic film.

3. Current connection according to claim 1, wherein the insulator consists of an adhesive joint connecting the individual current conductors to each other by their adjacent surfaces.

4. Current connection according to claim 1, wherein the paired conductor rails are made of copper, preferably of a highly conductive copper-based alloy.

5. Current connection, according to claim 1, wherein the first current conductor pair is connected at one end to the power generator and is in electrical contact at the other end over a large surface area with the first, stationary conductor ring flange, as a result of which a homogeneous, uniform distribution of the current feed, preferably for alternating current, from the first current conductor pair to the first conductor ring flange and a uniform power distribution over the flexible current conductors, second current conductor flange are guaranteed.

6. Current connection according to claim 5, wherein the first current conductor pair is connected electrically with the outer conductor ring over more than one-third of its circumferential contact surface with preferably mirror-image symmetry of the contact transitions.

7. Current connection according to claim 1, wherein the individual conductors of the first current conductor pair or the individual conductors of the second current conductor pair have a rectangular cross section.

8. Current connection according to claim 1, wherein the individual current conductors of the current conductor pair or the individual conductors of the first current conductor pair consist of electrically conductive tubular conductors flows.

9. Current connection according to claim 1, wherein in the lead-through area, the individual current conductors of the current conductor pair consist of concentric tubes, one inside the other, through which coolant flows.

10. Current connection according to claim 1, wherein the individual conductors have cooling apparatuses by means of which the temperature of the individual conductors can be regulated.

* * * * *